US006189992B1

(12) United States Patent
Suzuki

(10) Patent No.: US 6,189,992 B1
(45) Date of Patent: Feb. 20, 2001

(54) INK JET PRINTER

(75) Inventor: Shogo Suzuki, Nagoya (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/094,697

(22) Filed: Jun. 15, 1998

(30) Foreign Application Priority Data

Jul. 16, 1997 (JP) ..... 9-190884

(51) Int. Cl.[7] ..... B41J 29/38
(52) U.S. Cl. ..... 347/14
(58) Field of Search ..... 347/14, 10, 37, 347/39, 17, 20, 40, 48, 54, 194, 195, 58, 9

(56) References Cited

U.S. PATENT DOCUMENTS 4,167,014 * 9/1979 Darling et al. ..... 347/37
5,510,816 * 4/1996 Hosono et al. ..... 347/10

FOREIGN PATENT DOCUMENTS 2 281 954 * 11/1990 (JP) ..... 347/14
4 070 348 * 3/1992 (JP) ..... 347/14

* cited by examiner

*Primary Examiner*—John Barlow
*Assistant Examiner*—Charles W. Stewart, Jr.
(74) *Attorney, Agent, or Firm*—Oliff & Berridge, PLC

(57) ABSTRACT

An ink jet printer performs adjustments such that even if the ink ejection speed decreases, the ink droplet landing position on a recording sheet will not deviate. Based on the ink droplet transit time between ejection of an ink droplet and the landing thereof on the recording sheet, and the moving speed of the print head carriage, a control unit controls the time of applying a drive voltage to a piezoelectric element of a print head so that an ejected ink droplet lands at a predetermined position on the recording sheet being conveyed. During printing, the control unit receives a pulse signal from an encoder and detects the reception time thereof. The control unit then determines the next reception time by adding to the previous time, an encoder signal period based on the signals received. The control unit also determines an ink droplet transit time which depends on the characteristics of the piezoelectric elements, the power-on time, and the like. The control unit determines an ejection time by subtracting the droplet transit time from the reception time, so that the ink droplet ejected at the ejection time will land at an intended position on the recording sheet. The next ink droplet ejection time is determined by adding an ejection cycle to the ejection time, and the next ink droplet is ejected at that time. This ink ejecting operation is repeated upon arrival of later pulse signals.

19 Claims, 7 Drawing Sheets

INK JET PRINTER

BACKGROUND OF THE INVENTION

1. Field of Invention

The invention relates to the adjustment of ink ejection timing of an ink jet printer.

2. Description of Related Art

Known ink jet printers print on a recording sheet when the capacity of each ink reservoir chamber formed in an actuator of a print head is expanded and restored using piezoelectric elements, so that the ink in the reservoir chamber is pressurized and therefore ejected out of the ink ejecting pores formed in the ink reservoir chamber onto a recording sheet. A print head is normally mounted on a carriage for reciprocating movements in the direction along the width of a recording sheet. While being reciprocated, the print head ejects ink to form a print image on a recording sheet.

In an ink jet printer as described above, the ink ejecting pores are disposed at a predetermined distance apart from the plane of a recording sheet. Therefore, when an ink droplet is ejected out of an ink ejecting pore upon application of a drive voltage to the corresponding piezoelectric element, it takes a predetermined transit time for an ink droplet to land on a recording sheet. Consequently, in order to cause an ink droplet to land at a predetermined position on a recording sheet, it is necessary to apply the drive voltage to the corresponding piezoelectric element at a time that takes into account the transit time. The transit time of an ink droplet depends on the ejection speed of the ink droplet, the size of the gap between the ink ejecting pores and the plane of a recording sheet, and the like. Based on these factors and the moving speed of the print head mounted on the carriage, the time of ejecting an ink droplet can be determined. In other words, if the aforementioned quantities are estimated, the time for applying the drive voltage to an ink piezoelectric element can be determined so that an ejected ink droplet may land on a predetermined position on a recording sheet.

In the conventional ink jet printers, however, the displacement characteristic of the piezoelectric elements deteriorates over long periods of use so that the pressurization of the ink becomes insufficient, resulting in an undesirably reduced ejection speed of the ink droplets. The ink droplet ejection speed may also decrease due to deformation of component members of a print head, such as a diaphragm and the like, over long periods of use. Such a reduction in the ejection speed increases the ink droplet transit time so that the actual landing positions of ink droplets on a recording sheet deviate from the intended landing positions. Moreover, if a print head on the carriage reciprocates while ejecting ink droplets, a reduction in the ink droplet ejection speed results in deviations from the intended landing positions in opposite directions corresponding to the moving directions of the print head. In this case, a longitudinal line (in the paper-conveyance direction) printed on a recording sheet becomes rough or disturbed, thereby significantly degrading the print quality.

SUMMARY OF THE INVENTION

Accordingly, it is an aspect of the invention to provide an ink jet printer capable of correcting the application time of a drive voltage to piezoelectric elements on the basis of changes in the ink droplet ejection speed over time.

According to the invention, an ink jet printer is provided including a print head having an ink passage, a plurality of ink reservoir chambers branching from the ink passage and having ink ejecting holes, and a plurality of piezoelectric elements that change the capacity of the individual ink reservoir chambers. The print head ejects ink droplets from the ink ejecting holes to a recording medium that is conveyed in a conveyance direction. A mover unit moves the print head in a direction substantially orthogonal to the conveyance direction while the print head is ejecting an ink droplet to the recording medium. A drive voltage generator unit generates a drive voltage to deform at least one of the piezoelectric elements so that an ink droplet is ejected from at least one of the ink ejecting holes. On the basis of an ink droplet transit time between ejection of an ink droplet and the landing of the ink droplet on the recording medium, and a moving speed of the mover unit, an application timing control unit controls the application time of the drive voltage to a piezoelectric element so that an ink droplet ejected by the piezoelectric element lands at a predetermined ink droplet landing position on the recording medium. The application timing control unit corrects for a deviation in the ink droplet landing position caused by a change in the ink droplet transit time that is caused by a change in the ink droplet ejection speed over time. The correction is performed by changing the application time in accordance with the change in the ink droplet transit time.

In the ink jet printer of the invention, ink droplets are ejected from the ink ejecting holes of the print head by applying the drive voltage to the piezoelectric elements and thereby deforming the piezoelectric elements while the print head is being reciprocally moved in the directions orthogonal to the recording medium conveyance direction. The ink jet printer changes the application time of the drive voltage to eject an ink droplet, in accordance with the ink droplet transit time and the moving speed of the mover unit, so as to correct for a deviation in the ink droplet landing position caused by a change in the ink droplet transit time over time. Therefore, if the ink droplet ejection speed changes due to various factors and therefore changes the ink droplet transit time, the drive voltage application time is appropriately adjusted so as to offset the change in the ink droplet transit time. Consequently, the ink jet printer always prevents a deviation in the ink droplet landing position, and maintains good print quality without degradation.

The application timing control unit may determine an increase in the ink droplet transit time due to a decrease in the ink droplet ejection speed that is caused by a change in a deformation characteristic of the piezoelectric elements over time. A correction may be performed by advancing the application time by the increase in the ink droplet transit time.

With this structure, if the ink droplet ejection speed decreases due to a reduction in the amount of deformation of the piezoelectric elements that occurs over a long period of use, the application timing control unit advances the drive voltage application time by an increase in the ink droplet transit time. Therefore, if the ink droplet ejection speed decreases due to a long-time-use deterioration of the deformation characteristic of the piezoelectric element, the drive voltage application time will be adjusted to an optimal time. Consequently, the ink jet printer always prevents a deviation in the ink droplet landing position, and maintains good print quality without degradation.

The application timing control unit may determine the change in the ink droplet transit time based on a power-on time of the ink jet printer, and may perform the application time correction in accordance with the change in the ink droplet transit time.

With this structure, the drive voltage application time is determined on the basis of the power-on time of the ink jet printer. Therefore, if the characteristics of the piezoelectric elements or other component members change over a long period of use, the drive voltage application time will be adjusted to an optimal time. Consequently, the ink jet printer always prevents a deviation in the ink droplet landing position, and maintains good print quality without degradation.

The application timing control unit may determine the change in the ink droplet transit time based on an amount of ink used on the recording medium by the ink jet printer, and may perform the application time correction in accordance with the change in the ink droplet transit time.

With this structure, the drive voltage application time is determined on the basis of the amount of ink used by the ink jet printer. Therefore, if the characteristics of the piezoelectric elements or other component members change over a long period of use, the conditions of these component members, and the like, after the long hours of use can be estimated on the basis of the amount of ink used. The drive voltage application time can thereby be adjusted to an optimal time so that there will be no deviation in the ink droplet landing position and no degradation in print quality.

The application timing control unit may determine the change in the ink droplet transit time based on an amount of printing performed. The application time correction may then be performed in accordance with the change in the ink droplet transit time.

With this structure, the drive voltage application time is determined on the basis of the amount of printing performed by the ink jet printer. Therefore, if the characteristics of the piezoelectric elements or other component members change over a long period of use, the conditions of these component members, and the like, can be estimated on the basis of the amount of printing performed. The drive voltage application time can thereby be adjusted to an optimal time so that there will be no deviation in the ink droplet landing position and no degradation in print quality.

BRIEF DESCRIPTION OF THE DRAWINGS

A preferred embodiment of the invention will be described in detail with reference to the following figures wherein.

DETAILED DESCRIPTION OF PREFERRED EMBODIMENTS

A preferred embodiment of the present invention will be described in detail hereinafter with reference to the accompanying drawings.

Figure 1:
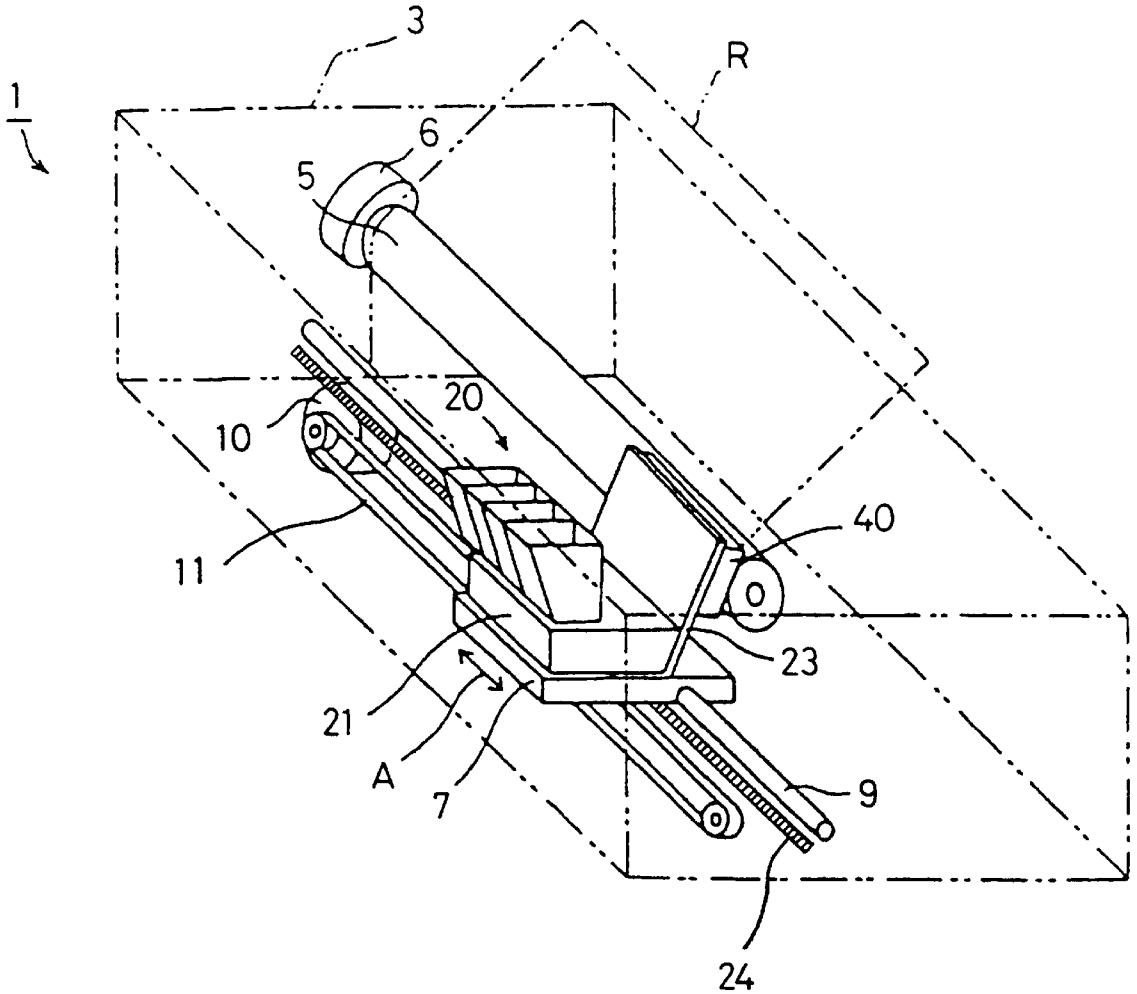
FIG. 1 is a perspective view of the internal structure of an ink jet printer according to the preferred embodiment of the invention.

FIG. 1 is a perspective view of an ink jet printer (hereinafter, also referred to simply as "printer") according to the preferred embodiment of the invention. The printer 1 has in its casing 3 a conveying roller 5 for conveying a recording sheet (or recording medium) R, to an upper portion of the printer 1. Provided in the conveyance path of the recording sheet R is a print head 20 supported by a carriage 7. The carriage 7 is supported by a support member 9 fixed to the casing 3 so that the carriage 7 is reciprocally movable in directions perpendicular to the direction of paper conveyance (as indicated by arrows A). The carriage 7 is fixed to a timing belt 11 that is driven by a carriage motor 10, whereby the carriage 7, carrying the print head 20, is reciprocated as indicated by arrows A.

The print head 20 has, at least, ink tanks 21 provided separately for four color inks (yellow, magenta, cyan and black), actuators 40 provided separately for the four colors, and a front panel 23 that conducts the ink from the ink tanks 21 to the corresponding actuators 40.

Extending along and below the support member 9 is a timing slit portion 24 having a plurality of slits (scale marks). Provided underneath the carriage 7 is an encoder device (not shown) for counting slits formed in the timing slit portion 24.

Figure 2:
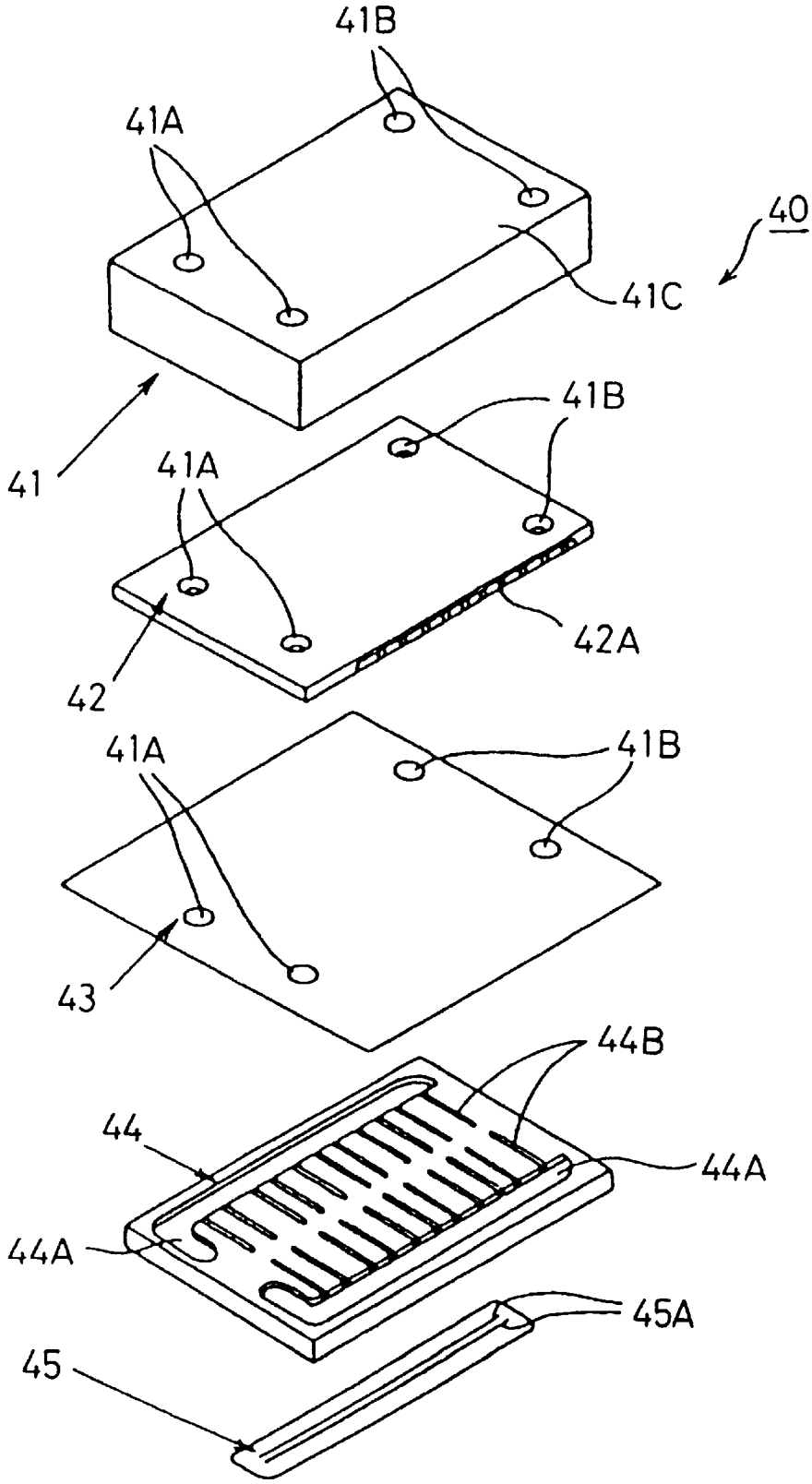
FIG. 2 is an exploded perspective view of an actuator of the ink jet printer shown in FIG. 1.

Each actuator 40 has, as shown in FIG. 2, a base 41, piezoelectric element member 42, diaphragm 43, a cavity plate 44 and a nozzle plate 45. The nozzle plate 45 is a flat plate having many (e.g., 128) ink ejecting pores 45A that are arranged in two rows.

The cavity plate 44 has a pair of "L"-shaped ink channels 44A, and reservoir chambers 44B branching orthogonally from the ink channels 44A. The number of ink reservoir chambers 44B is equal to the number of the ejecting pores 45A. Each ink reservoir chamber 44B communicates with the corresponding one of the ejecting pores 45A.

The piezoelectric element member 42 has many (e.g., 128) piezoelectric elements 42A so as to expand and restore the reservoir chambers 44B individually. The diaphragm 43 separates the piezoelectric element member 42 and the cavity plate 44 from each other. The diaphragm 43 has an elasticity.

The base 41 supports these components of the actuator 40. Two supply ink channels 41A and two return ink channels 41B extend through the base 41, the piezoelectric element member 42 and the diaphragm 43, in order to circulate ink between the ink channels 44A and the corresponding ink tank (not shown).

Figure 3:
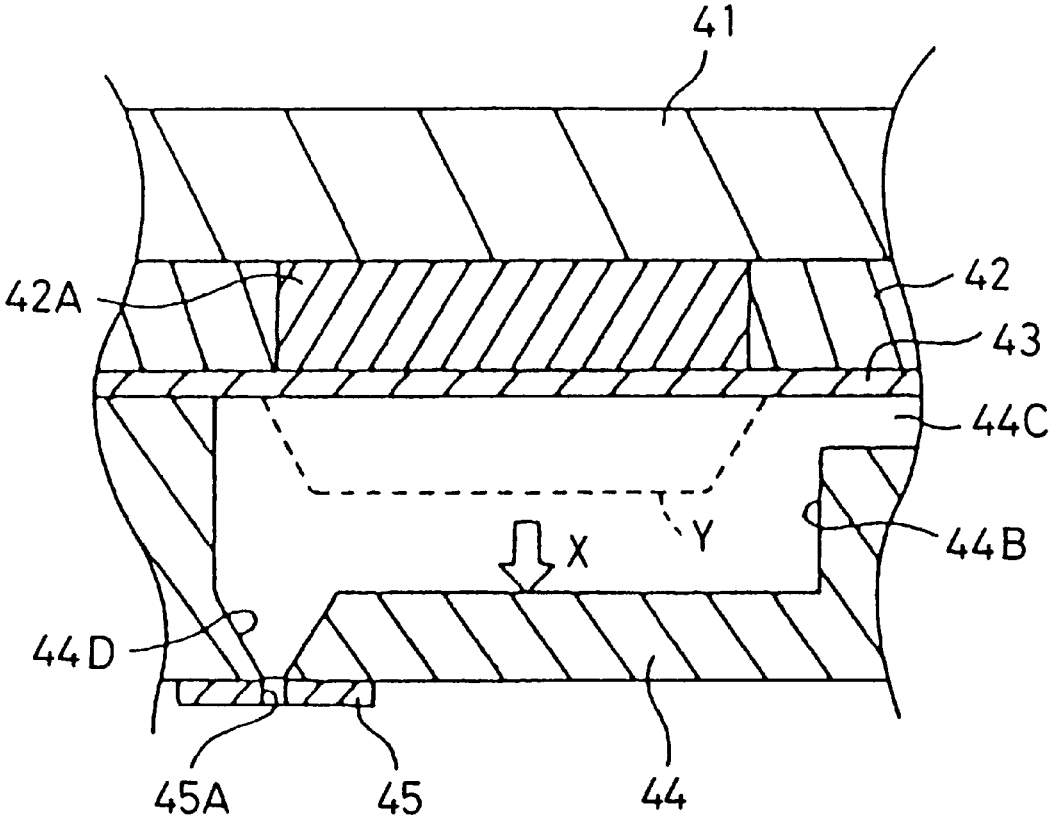
FIG. 3 is a longitudinal sectional view of the actuator shown in FIG. 2.

One of the ink reservoir chambers 44B is shown in the enlarged sectional view in FIG. 3. An ink reservoir chamber 44B formed in the cavity plate 44 communicates with an ink channel 44A (FIG. 2) through a communication channel 44C. An orifice 44D is formed in a lower portion of the ink reservoir chamber 44B, and communicates with the corresponding one of the ejecting pores 45A of the nozzle plate 45.

Upon application of a drive voltage, the piezoelectric element 42A expands in a direction indicated by an arrow X, reducing the capacity of the reservoir chamber 44B as indicated by a broken line Y. When the application of the drive voltage is discontinued, the piezoelectric element 42A resumes the original state, thereby restoring the capacity of the ink reservoir chamber 44B.

The operation of ejecting ink from the actuators 40 of the print head 20 constructed as described above, will be described below with reference to FIGS. 1–3.

Ink from an ink tank is sent by pressure to the two ink channels 44A through the two supply ink channels 41A, thereby filling the ink channels 44A. When the piezoelectric elements 42A are restored by discontinuing application of the drive voltage thereto, ink is drawn into the reservoir chambers 44B from the ink channels 44A through the communication channels 44C, thereby filling the reservoir chambers 44B with ink. When the drive voltage is applied to a piezoelectric element 42A to reduce the capacity of the reservoir chamber 44B, ink is ejected out of the orifice 44D.

Figure 4:
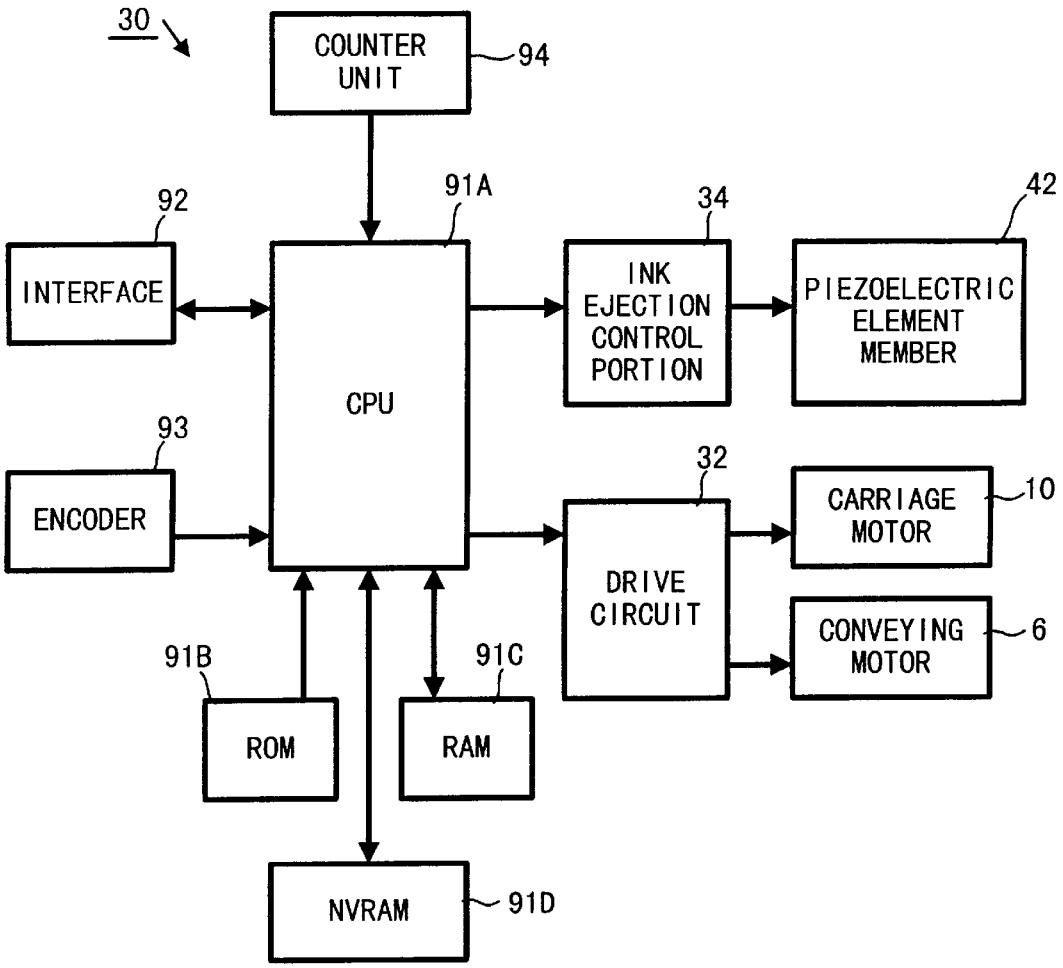
FIG. 4 is a block diagram of a control device of the ink jet printer.

A control device 30 that controls the ink ejection of the printer 1 will be described with reference to the block diagram of FIG. 4. The control device 30 has a CPU 91A that performs various operations, a ROM 91B and a RAM 91C for storing programs, parameters, and the like, necessary for the control of the printer 1, an interface 92 for the data exchange necessary for recording between the printer 1 and a personal computer (not shown), an encoder 93 for reading slits formed in the timing slit portion 24 and outputting a pulse signal, a drive circuit 32 for driving the carriage motor 10 and a conveying motor 6 based on control signals from the CPU 91A, an ink ejection control portion 34 for controlling and performing the ink ejection from each actuator 40 by expanding and restoring the individual piezoelectric elements 42A of the piezoelectric element member 42, counter unit 94 for counting the time that the printer 1 has been powered on, or for counting the number of pages printed, and a non-volatile RAM 91D for storing the count value after the printer 1 is powered off.

Figure 5:
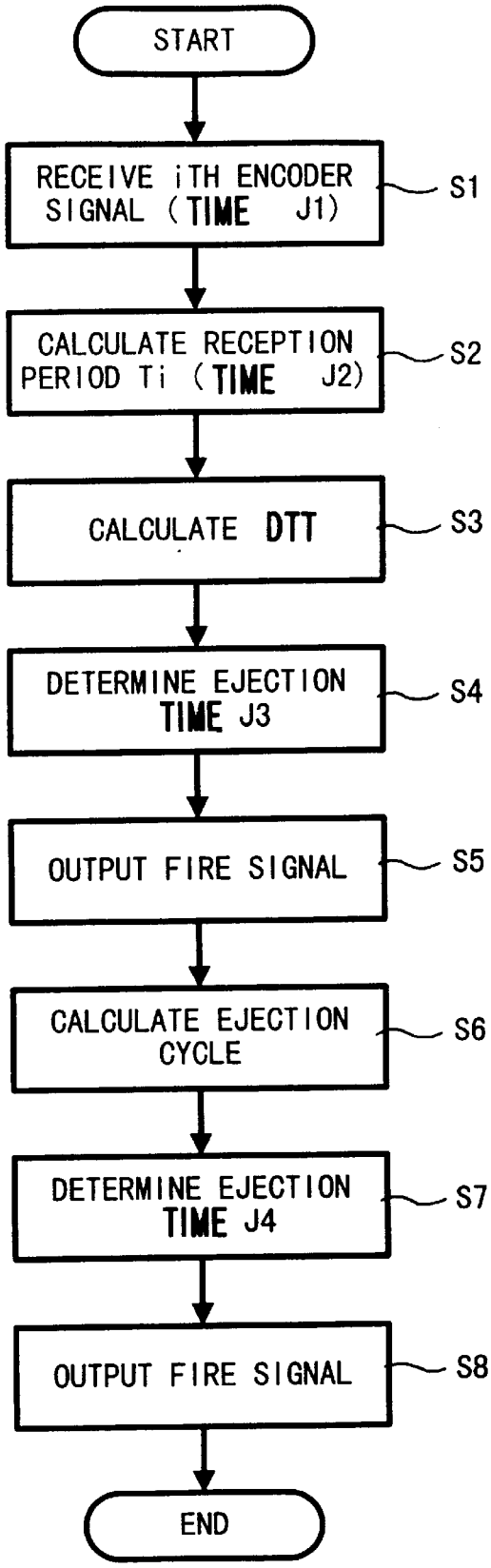
FIG. 5 is a flowchart of an ink ejection control operation performed by the ink jet printer.
Figure 6:
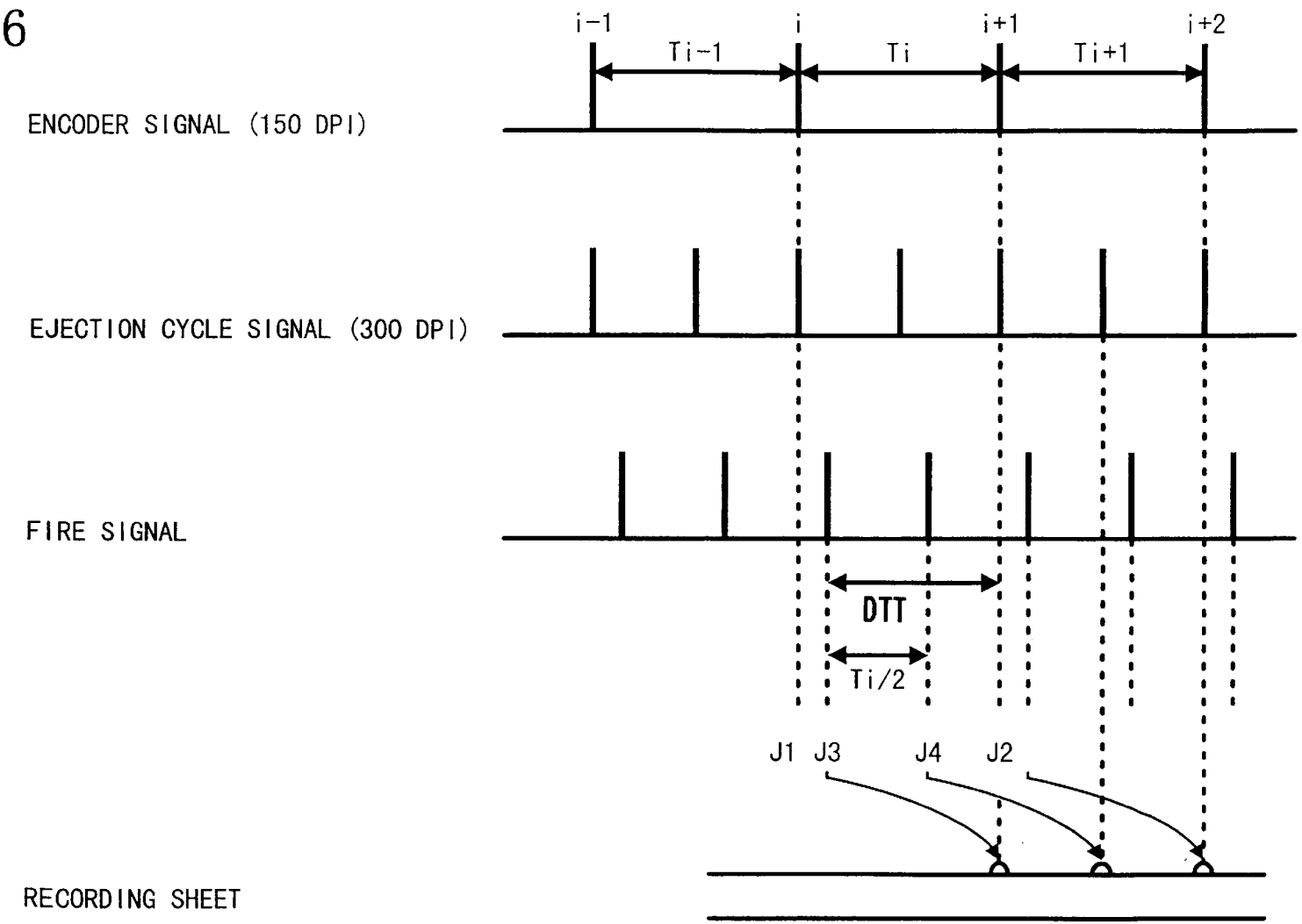
FIG. 6 is a timing chart of the ink ejection control.

The ink ejection control operation executed by the CPU 91A to eject ink from the actuators 40 of the printer 1, will be described with reference to the flowchart of FIG. 5 and the timing chart of FIG. 6. The operation will be described in conjunction with the situation where the encoder 93 outputs to the CPU 91A, a pulse signal based on the $i^{th}$ slit formed in the timing slit portion 24, while the print head 20 is being moved by the carriage 7 and is printing on the recording sheet R.

It is assumed in the description that the resolution of an image formed on the recording sheet R by the ink jet printer 1 is 300 dpi, and that the slits of the timing slit portion 24 are arranged at 150 dpi. Based on this slit interval, various resolutions can be handled. For example, using half the slit interval of the timing slit portion 24 as a reference, a print resolution of 300 dpi can be handled. The period of the pulse signal based on the timing slit portion 24 varies depending on the speed of the carriage 7 in the main scanning direction. In this embodiment, the pulse signal period (or cycle) is at most 250 $\mu$sec, and a timing clock is provided so that the time of generating a fire signal can be changed in units of 4 $\mu$sec, which is sufficiently small relative to the signal period.

When the pulse signal output from the encoder 93 based on the $i^{th}$ slit arrives at a time J1, the CPU 91A receives that pulse signal from the encoder 93 and sets J1 as a reference time for the ejection control on the individual actuators 40 in step S1. The CPU 91A calculates the period T(i−1) of the encoder signals from the time J1 and the time of reception of the previous pulse signal, (i.e., the $(i-1)^{th}$ pulse signal) and, using the period T(i−1) as a basis, predicts and calculates the time J2 corresponding to the arrival of the next pulse signal in step S2.

Given an ink droplet transit time (DTT), it is possible to determine a drive time J3 of a fire signal for ink ejection. The transit time DTT is a length of time between the output of a fire signal and the landing of an ink droplet on the surface of the recording sheet R. The transit time DTT is determined by the ink ejection speed, the size of the gap between the print head 20 and the recording sheet R, and the like. Therefore, if these factors are constant, the time DTT becomes a fixed value. However, because the transit time DTT normally varies depending on various factors, it is necessary to appropriately update the value of the time DTT.

Factors that may change the value DTT can be, for example, the deformation characteristic of the piezoelectric element member 42, the power-on time, the number of pages printed, the amount of ink used, and the like. The displacement characteristic of the piezoelectric element member 42 deteriorates over a long period of use, thereby reducing the ink droplet ejection speed. The power-on time is counted by the counter unit 94, which can be used as a basis for estimating an approximate time length of use of the piezoelectric element member 42. The power-on time can also be used as a basis for estimating a reduction in the ink droplet ejection speed caused by an elongation of the diaphragm 43, and the like. The number of pages printed and the amount of ink used, also provide bases for estimating a reduction in the ink droplet ejection speed. The amount of ink used can be estimated by counting the number of times new ink pellets are supplied, or the number of times each nozzle is fired. Therefore, the CPU 91A is able to calculate a value DTT in an appropriate manner from the pre-stored correspondence between these factors and changes in the value DTT in step S3. It is also possible to store the correspondence between these factors and changes in the value DTT in the form of a table in the ROM 91B. Since the value DTT does not sharply change, the calculation of a value DTT does not need to be frequently performed, but may be changed at appropriate time or frequency, for control.

The DTT calculation time may occur, for example, at a predetermined length of time after the apparatus is powered on, at the time of completion of recording of a page, during the execution of a test print mode, and the like.

Figure 7:
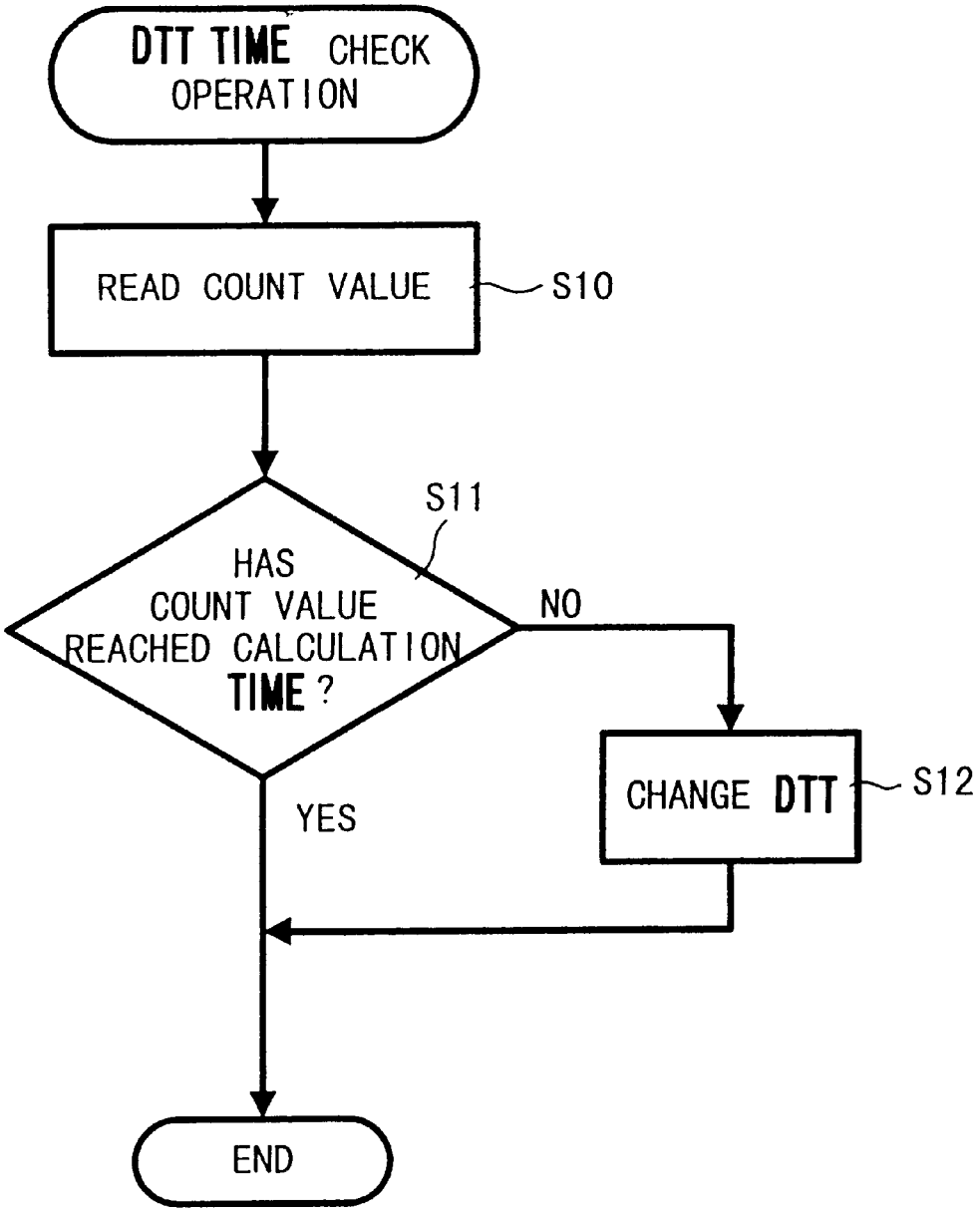
FIG. 7 is a flowchart of a DTT calculation time check operation.

The DTT calculation time check operation will be described with reference to FIG. 7. In step S10, if the calculation time occurs at a predetermined length of time after the apparatus is powered on, the CPU 91A reads the power-on time as a count value. If the calculation time occurs at the completion of printing of one page, the CPU 91A reads the amount of ink used (number of times of ejection) as a count value. If the calculation time occurs during the execution of the test print mode, the CPU 91A reads the number of pages printed as a count value.

Subsequently in step S11, it is determined whether the count value has reached a change time. If the count value has reached the change time (YES in step S11), the CPU 91A ends the check operation, and returns to the normal operation illustrated in FIG. 5. Conversely, if the count value has not reached the change time (NO in step S11), the CPU 91A proceeds to step S12, where the value DTT is changed. Since the DTT value gradually changes, it is desirable to change the DTT value at a time after printing has been substantially completed. At least, the changing operation should preferably be performed such that if the change time is reached during printing, the changing operation is delayed until the printing of the current page has been completed, because such an operation avoids remarkably disturbed or rough print. After the DTT value is changed, the CPU 91A returns to the normal operation illustrated in FIG. 5.

Based on the transit time value DTT, the CPU 91A determines an ejection time, that is, the drive time J3 of a fire signal in step S4. Subsequently in step S5, the CPU 91A outputs a fire signal at the time J3, so that an ink droplet is ejected from the print head 20 and lands at an intended dot position on the recording sheet R.

Next described will be an operation for causing an ink droplet to land at the next dot on the recording sheet R adjacent to the dot. For matching of the encoder signal period (cycle) T(i−1) with 300 dpi, the CPU 91A calculates an ejection cycle of the print head 20 by dividing the value T(i−1) by 2, in step S6. In step S7, the CPU 91A adds the calculated value to the time J3 and thereby determines the next fire signal drive time J4. In step S8, the CPU 91A outputs a fire signal at the time J4, so that an ink droplet is ejected from the print head 20 and lands at the next dot position on the recording sheet R.

After the CPU 91A receives the (i+1)th pulse signal from the encoder 93, the CPU 91A repeatedly performs the operation as described above until the movement of the carriage 7, carrying the print head 20, is completed.

This embodiment may be modified as follows. That is, the printer has a memory for storing count values, and the printer driver of the personal computer connected to the printer via the interface, checks the content of the memory of the printer. If the personal computer determines that the DTT value needs to be changed, the personal computer sends data for changing the DTT value, to the printer. Based on the data from the personal computer, the printer changes the DTT value. Furthermore, the printer driver may send to the printer, data regarding the use of the printer, for every page, so that the printer correspondingly updates the counter value (e.g., by the number of times the nozzle is used).

Through the above-described control of the ink droplet ejection time, the ink jet printer 1 is able to print at predetermined positions on the recording sheet R without allowing a deviation in ink droplet landing positions, despite changes in the ink droplet ejection speed over long periods of use. The ink droplet ejection time control may also be performed in both moving directions of the carriage 7, whereby printing on a recording sheet R in both transverse directions can be accurately performed without a disturbance, even in printing a longitudinal line.

As understood from the above description, the ink jet printer of the invention is able to adjust the application time of the drive voltage for ink ejection so that ink droplets land at intended landing positions even if the ink droplet ejection speed varies over time and thereby changes the ink droplet transit time. Therefore, the ink jet printer maintains good print quality without allowing a deviation in ink droplet landing positions, over long periods of use.

Even if the displacement of piezoelectric elements decreases over a long period of use and therefore reduces the ink droplet ejection speed, the ink jet printer of the invention is capable of adjusting the drive voltage application time, by increasing the time, so as to offset the increase in the ink droplet transit time. Consequently, the ink jet printer prevents a deviation in ink droplet landing positions and therefore maintains good print quality without degradation over time.

Furthermore, the ink jet printer of the invention is capable of adjusting the drive voltage application time as described above, based on the power-on time of the printer. Therefore, if the characteristics of the piezoelectric elements or other component members change over a long period of use, the drive voltage application time can be adjusted to an optimal time, so that there will be no substantial deviation in ink droplet landing positions and therefore no print quality degradation.

Further, the ink jet printer of the invention is capable of adjusting the drive voltage application time as described above, based on the amount of ink used by the printer. More specifically, based on the amount of ink used, it is possible to estimate long-term-use changes of the characteristics of the piezoelectric elements or other component members and to thereby adjust the drive voltage application time to an optimal time. Consequently, the ink jet printer prevents a deviation in ink droplet landing positions and therefore maintains good print quality without degradation over time.

Further, the ink jet printer of the invention is capable of adjusting the drive voltage application time as described above, based on the amount of printing performed by the printer. More specifically, based on the amount of printing performed, it is possible to estimate long-term-use changes of the characteristics of the piezoelectric elements or other component members and to thereby adjust the drive voltage application time to an optimal time. Consequently, the ink jet printer prevents a deviation in ink droplet landing positions and therefore maintains good print quality without degradation over time.

It is to be understood that the invention is not restricted to the particular forms shown in the foregoing embodiment. Various modifications and alternations can be made thereto without departing from the spirit of the invention.

What is claimed is:

1. An ink jet printer comprising:

a print head having an ink passage, a plurality of ink reservoir chambers branching from the ink passage and having a plurality of ink ejecting holes, and a plurality of deformable elements that change a capacity of the individual ink reservoir chambers, the print head ejecting ink droplets from the plurality of ink ejecting holes to a recording medium that is conveyed in a conveyance direction;

a mover unit that moves the print head in a direction substantially orthogonal to the conveyance direction while the print head is ejecting ink droplets to the recording medium;

a drive voltage generator unit that generates a drive voltage to deform at least one of the plurality of deformable elements so that an ink droplet is ejected from at least one of the plurality of ink ejecting holes; and an application timing control unit that, on the basis of an ink droplet transit time between ejection of an ink droplet and the landing of the ink droplet on the recording medium, and a moving speed of the mover unit, controls a drive voltage application time to a deformable element so that an ink droplet ejected by the deformable element lands at a predetermined ink droplet landing position on the recording medium, wherein the application timing control unit corrects the drive voltage application time for a deviation in the ink droplet landing position caused by a change in the ink droplet transit time caused by a gradual change in ink droplet ejection speed.

2. The ink jet printer according to claim 1, wherein the deformable elements are piezoelectric elements.

3. The ink jet printer according to claim 2, wherein the application timing control unit determines an increase in the ink droplet transit time due to a decrease in the ink droplet ejection speed that is caused by a gradual change of a deformation characteristic of the piezoelectric elements, and performs a correction to the drive voltage application time by advancing the drive voltage application time by the increase in the ink droplet transit time.

4. The ink jet printer according to claim 2, wherein the application timing control unit determines the change in the ink droplet transit time based on a power-on time of the ink jet printer, and performs the correction of the drive voltage application time in accordance with the change in the ink droplet transit time.

5. The ink jet printer according to claim 2, wherein the application timing control unit determines the change in the ink droplet transit time based on an amount of ink used on the recording medium by the ink jet printer, and performs the correction of the drive voltage application time in accordance with the change in the ink droplet transit time.

6. The ink jet printer according to claim 2, wherein the application timing control unit determines the change in the ink droplet transit time based on an amount of printing on the recording medium, and performs the correction of the drive voltage application time in accordance with the change in the ink droplet transit time.

7. An ink jet printer comprising:

a print head having an ink passage, a plurality of ink reservoir chambers branching from the ink passage and having a plurality of ink ejecting holes, and a plurality of deformable elements that change a capacity of the individual ink reservoir chambers, the print head ejecting ink droplets from the plurality of ink ejecting holes to a recording medium that is conveyed in a conveyance direction;

moving means for moving the print head in a direction substantially orthogonal to the conveyance direction while the print head is ejecting ink droplets to the recording medium;

drive voltage generator means for generating a drive voltage to deform at least one of the plurality of deformable elements so that an ink droplet is ejected from at least one of the plurality of ink ejecting holes; and application timing control means for, on the basis of an ink droplet transit time between ejection of an ink droplet and the landing of the ink droplet on the recording medium, and a moving speed of the mover means, controls a drive voltage application time to a deformable element so that an ink droplet ejected by the deformable element lands at a predetermined ink droplet landing position on the recording medium, wherein the application timing control means corrects the drive voltage application time for a deviation in the ink droplet landing position caused by a change in the ink droplet transit time caused by a gradual change in ink droplet ejection speed.

8. The ink jet printer according to claim 7, wherein the deformable elements are piezoelectric elements.

9. The ink jet printer according to claim 8, wherein the application timing control means determines an increase in the ink droplet transit time due to a decrease in the ink droplet ejection speed that is caused by a gradual change of a deformation characteristic of the piezoelectric elements, and performs a correction to the drive voltage application time by advancing the drive voltage application time by the increase in the ink droplet transit time.

10. The ink jet printer according to claim 8, wherein the application timing control means determines the change in the ink droplet transit time based on a power-on time of the ink jet printer, and performs the correction of the drive voltage application time in accordance with the change in the ink droplet transit time.

11. The ink jet printer according to claim 8, wherein the application timing control means determines the change in the ink droplet transit time based on an amount of ink used on the recording medium by the ink jet printer, and performs the correction of the drive voltage application time in accordance with the change in the ink droplet transit time.

12. The ink jet printer according to claim 8, wherein the application timing control unit determines the change in the ink droplet transit time based on an amount of printing on the recording medium, and performs the correction of the drive voltage application time in accordance with the change in the ink droplet transit time.

13. An ink jet printer comprising:

a print head having an ink passage, a plurality of ink reservoir chambers branching from the ink passage and having a plurality of ink ejecting holes, and a plurality of deformable elements to which a drive voltage is applied;

a mover unit that moves the print head;

an application timing control unit that controls a drive voltage application time to a deformable element based on a gradual change in ink droplet ejection speed.

14. The ink jet printer according to claim 13, wherein the application timing control unit controls the drive voltage application time on the basis of an ink droplet transit time between ejection of an ink droplet and the landing of the ink droplet on a recording medium, and a moving speed of the mover unit.

15. The ink jet printer according to claim 14, wherein the deformable elements are piezoelectric elements.

16. The ink jet printer according to claim 15, wherein the application timing control unit determines an increase in the ink droplet transit time due to a decrease in the ink droplet ejection speed that is caused by a gradual change of a deformation characteristic of the piezoelectric elements, and performs a correction to the drive voltage application time by advancing the drive voltage application time by the increase in the ink droplet transit time.

17. The ink jet printer according to claim 15, wherein the application timing control unit determines the change in the ink droplet transit time based on a power-on time of the ink jet printer, and performs the correction of the drive voltage application time in accordance with the change in the ink droplet transit time.

18. The ink jet printer according to claim 15, wherein the application timing control unit determines the change in the ink droplet transit time based on an amount of ink used on the recording medium by the ink jet printer, and performs the correction of the drive voltage application time in accordance with the change in the ink droplet transit time.

19. The ink jet printer according to claim 15, wherein the application timing control unit determines the change in the ink droplet transit time based on an amount of printing on the recording medium, and performs the correction of the drive voltage application time in accordance with the change in the ink droplet transit time.

* * * * *